US005597987A

United States Patent [19]

Gilliland et al.

[11] Patent Number: 5,597,987

[45] Date of Patent: Jan. 28, 1997

[54] TWIN POST, TELESCOPING JACK HYDRAULIC ELEVATOR SYSTEM

[75] Inventors: Oscar Gilliland, Nesbit, Miss.; Foad Vafaie, Germantown; Martin W. Hughes, Memphis, both of Tenn.; Charlie R. Thurmond, III, Southaven, Miss.; Paul Tomes, Memphis, Tenn.

[73] Assignee: Delaware Capital Formation, Inc., Wilmington, Del.

[21] Appl. No.: 377,078

[22] Filed: Jan. 25, 1995

[51] Int. Cl.[6] ..... B66B 9/04; B66B 1/04

[52] U.S. Cl. ..... 187/285; 187/274; 187/394; 91/170 R

[58] Field of Search ..... 187/391, 393, 187/394, 277, 282, 285, 286, 274, 275; 91/170 R, 171; 60/480, 484

[56] References Cited

U.S. PATENT DOCUMENTS

| | | | |
|---|---|---|---|
| 4,043,428 | 8/1977 | White et al. | 187/17 |
| 4,201,053 | 5/1980 | Atkey | 60/459 |
| 4,357,995 | 11/1982 | Kappenhagen | 187/17 |
| 4,706,458 | 11/1987 | Corghi | 60/546 |
| 5,060,762 | 10/1991 | White | 187/17 |
| 5,065,844 | 11/1991 | Hon | 187/17 |

*Primary Examiner*—Robert Nappi
*Attorney, Agent, or Firm*—White & Case

[57] ABSTRACT

A twin post, telescoping jack hydraulic elevator system has a pair of dynamic sensors to determine when the jacks are out of synchronization, by determining any relative differences in height between the two intermediate cylinders. The elevator also includes static sensors to determine if one or both intermediate cylinders are more than a predetermined distance away from their normal positions when the car is stopped at each floor. The controller actuates a resynchronization if the distance between the intermediate jacks exceeds a first threshold, and shuts down the elevator if the distance exceeds a second threshold or if resynchronization demands are issued too often. Preferably, the static sensors are positioned to detect the seal housing at the top of the intermediate cylinder, which projects outwardly from the cylinder.

14 Claims, 8 Drawing Sheets

TWIN POST, TELESCOPING JACK HYDRAULIC ELEVATOR SYSTEM

FIELD OF INVENTION

The present invention relates to hydraulic elevator systems in which a car is supported on two, telescoping cylinder hydraulic jacks.

BACKGROUND OF THE INVENTION

Dual post elevators are used in applications where it is not desirable to drill a hole for a hydraulic jack. As opposed to a single post elevator, where the jack is located under the car, in dual post elevators a pair of jacks are located on opposite sides of the car. The inner plunger of the jack is connected to the top of the car, whereas the outer cylinder of the jack is supported by the ground.

For hydraulic jacks having a single extending cylinder, the height that car can be raised is limited essentially to the height of the jack. It is therefore desirable in many dual post applications to employ telescoping jacks, e.g., jacks having an inner plunger coupled to the car, the outer cylinder fixed relative to the ground, and one or more intermediate cylinders.

When dual post telescoping jacks are used in an elevator system, there exists the problem that, over time, one or both of the jacks may get out of synchronization due to loss of fluid in the upper chamber, as described below with reference to FIG. 1.

FIG. 1 illustrates, in somewhat simplified form, a telescoping jack 10. The jack includes a first cylinder 14, which is normally fixed relative to the ground. An intermediate cylinder 16 is disposed within the first cylinder 14, and slidable relative thereto through a hydraulic seal 18, which is secured to the first cylinder 14 by a seal collar, or housing 20. An inner plunger 32 is disposed in the intermediate cylinder 16, and slidable relative thereto through a hydraulic seal 28. The hydraulic seal 28 is secured in an intermediate seal housing 29. As shown, the intermediate seal housing 29 extends outwardly from the central cylinder axis 30 further than the intermediate cylinder 16 itself. The inner plunger 32 is preferably closed off at its lower end by a stop 34.

The intermediate cylinder 16 includes a piston 22 which is slidingly mounted in the first cylinder 14 and includes a hydraulic seal 24 between the piston 22 and the adjacent cylinder wall. The piston 22 divides the main cylinder 14 into a lower chamber 12*a* and an upper chamber 12*b*.

As the cross-sectional area of the intermediate cylinder 16 is less than the first cylinder 14, an annular chamber 36 is formed between these two cylinders. Passages 38 are provided to maintain the chamber 36 in fluid communication with the interior of the intermediate cylinder 16.

In normal operation, there is no fluid communication between the lower chamber 12*a* and the upper chamber 12*b*. In order to extend the jack, fluid from reservoir 40 is pumped into the lower chamber 12*a* by pump 42, which pushes upwardly on piston 22. As the piston 22 begins to rise, the volume in chamber 36 begins to decrease, forcing fluid from the chamber 36 into the interior of the intermediate cylinder 16. The resultant pressure increase within the intermediate cylinder 16 pushes the inner plunger 32 outwardly relative to the intermediate cylinder 16 so as to maintain the overall volume in the upper chamber 12*b* substantially constant.

In telescoping jacks of this type, the intermediate cylinder 16 and the inner plunger 32 thus inherently move outwardly simultaneously. The jacks are designed so that the inner plunger reaches its outermost position, defined by stop 44, at the same time the intermediate cylinder reaches its outermost position, when the upper side 46 of the piston reaches the bearing housing 20 (alternatively, stops can be secured to the intermediate cylinder).

Initially, the upper chamber 12*b* is completely filled with hydraulic fluid. Over time, fluid tends to leak out through the seals 18 and 28, so that the upper chamber 12*b* is no longer completely filled with fluid. When this occurs, the intermediate cylinder 16 and inner plunger 32 are no longer able to extend their full range. It is thus necessary, from time-to-time, to resupply hydraulic fluid to the upper chamber 12*b*.

Thus, telescoping jacks are typically provided with a mechanism to transfer fluid from the lower chamber 12*a* to the upper chamber 12*b*. A simplified version of such a mechanism 50 is shown in FIG. 1. As shown, during normal operation of the elevator, flow of oil from the lower chamber 12*a* to the upper chamber 12*b* is blocked by piston 52, which is retained in sealed position in seat 54 by spring 56 and also by the pressure of the oil from chamber 12*a*.

If the car is lowered to its lowermost position, the stop 34 pushes the valve housing 58 downwardly, opening valve 52, 54 and allowing pressurized oil from the lower chamber 12*a* to flow into the upper chamber 12*b*. As soon as the car moves upwardly again a short distance, the spring 56 forces the valve 52, 54 closed again.

During normal elevator operation, when the elevator car is at the lowest floor, the jack is not at its lowest position, and thus fluid is not replenished into the upper chamber. Rather, replenishing oil into the upper chamber is normally done as part of elevator servicing. This operation, which is referred to as resynchronization, is well know and need not be described further here.

In an elevator having a single telescoping jack, loss of fluid in the upper chamber 12*b* means that an elevator car may not be able to reach the upper floor. In a twin post telescoping jack elevator, however, the problem can be more serious, because one jack can lose oil faster than the other and become out of synchronization with the other. Thus, the two jacks need to be re-synchronized, which is done by lowering the car so as to actuate the refilling mechanisms of both jacks.

If on dual post elevators one of the jacks becomes much more out of sync than the other, the out-of-sync jack may bottom out (i.e., reach the limit of its upward movement) while running up. This will cause one jack to stop moving while the other jack continues to extend, causing the car to rack.

Presently, this problem is dealt with by building the car sling strong enough to prevent the unbalance from racking it. This requires the car sling to be built with much more steel, which adds considerably to the cost of the elevator. It also results in increased power unit requirements to handle the extra weight.

SUMMARY OF THE INVENTION

The present invention is a hydraulic elevator system having a car moveable in a shaft between at least two floors, and a pair of telescoping jacks for supporting the car at spaced locations and for raising and lowering the car between floors. Each telescoping jack has a first cylinder, e.g., an inner plunger, coupled to the car, a second cylinder fixed relative to the ground, and at least one intermediate cylinder. A sensing means, located at least one predetermined vertical position in the shaft, detects each intermediate cylinder. A controller, connected to the sensing means, determines relative differences in height between the intermediate cylinders in order to determine when the two jacks are out of synchronization and a resynchronization is required.

In a dual post telescoping jack elevator, the positions of the inner plungers remain fixed relative to one another, because both are attached to the car, and the positions of both the outer cylinders remain fixed relative to one another. Therefore, the positions of the outer cylinder and inner plunger do not indicate an out-of-sync condition.

However, telescoping jacks are designed so that, if they are operating properly, there is a fixed relationship between the amount of extension of the inner plunger and the amount of extension of the intermediate cylinder (normally a 2/1 ratio). Therefore, at any given vertical location of the car within the shaft, the intermediate cylinders of the two telescoping jacks should be extended by a predetermined amount. If either intermediate cylinder is not in its predesigned position, or the two intermediate cylinders are extended by different amounts, it means that the jacks are out of synchronization, and that a resynchronization operation should be performed.

Preferably, the sensing means comprises a pair of static sensors, one associated with each jack, for each floor. The sensor pairs are located in the shaft so as to be actuated by a respective intermediate cylinder when the jack is in synchronization and the car is stopped at the respective predetermined floor.

Preferably also, the sensing means comprises a pair of dynamic sensors, one associated with each jack, which are located in the shaft at a predetermined vertical position and so as to be actuated by a respective intermediate cylinder during an up run. The controller includes means for determining relative differences in height between the two intermediate cylinders at the time the intermediate cylinders pass the dynamic sensors.

Preferably, the controller determines the time interval between actuation of the respective dynamic sensors, and determines relative differences in height between the two intermediate cylinders as the product of the time interval and instant elevator speed. Also, preferably, all the static sensors associated with each jack are wired together to provide a single input signal to the controller.

In the preferred embodiment, the intermediate cylinder has a seal housing at its upper end that projects outwardly a distance greater than the intermediate cylinder itself. The static sensors are located so as to detect the seal housing but not the intermediate cylinder. The dynamic sensors are also positioned to detect the seal housing, but preferably are located somewhat closer to the intermediate cylinder than the static sensors. The dynamic sensors can be located so as to be activated both by the seal housing and the intermediate cylinder.

The controller initiates resynchronization of the jacks automatically in response to detecting more than a certain height difference between the intermediate cylinders. It shuts the elevator down if the height difference exceeds a second threshold, or if resynchronizations are called for too often.

For a better understanding of the invention, reference is made to the following detailed description of a preferred embodiment, taken in conjunction with the drawings accompanying the application.

FIGS. *6a–6d* are flow diagrams of the controller system.

DETAILED DESCRIPTION OF A PREFERRED EMBODIMENT

Figure 1:
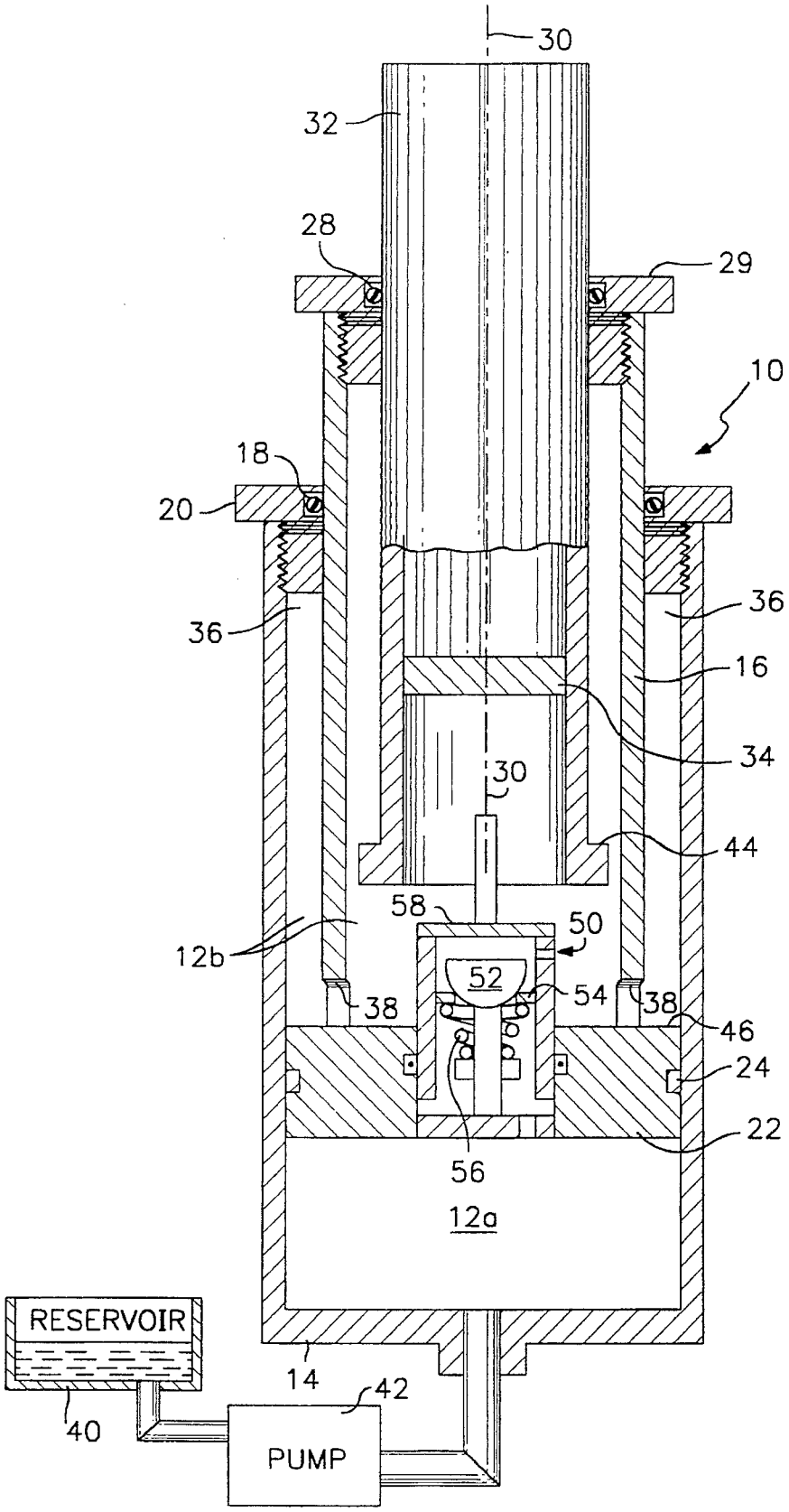
FIG. 1 is a sectional view of a known telescoping hydraulic elevator as an example of one that may be employed in the present invention.
Figure 2:
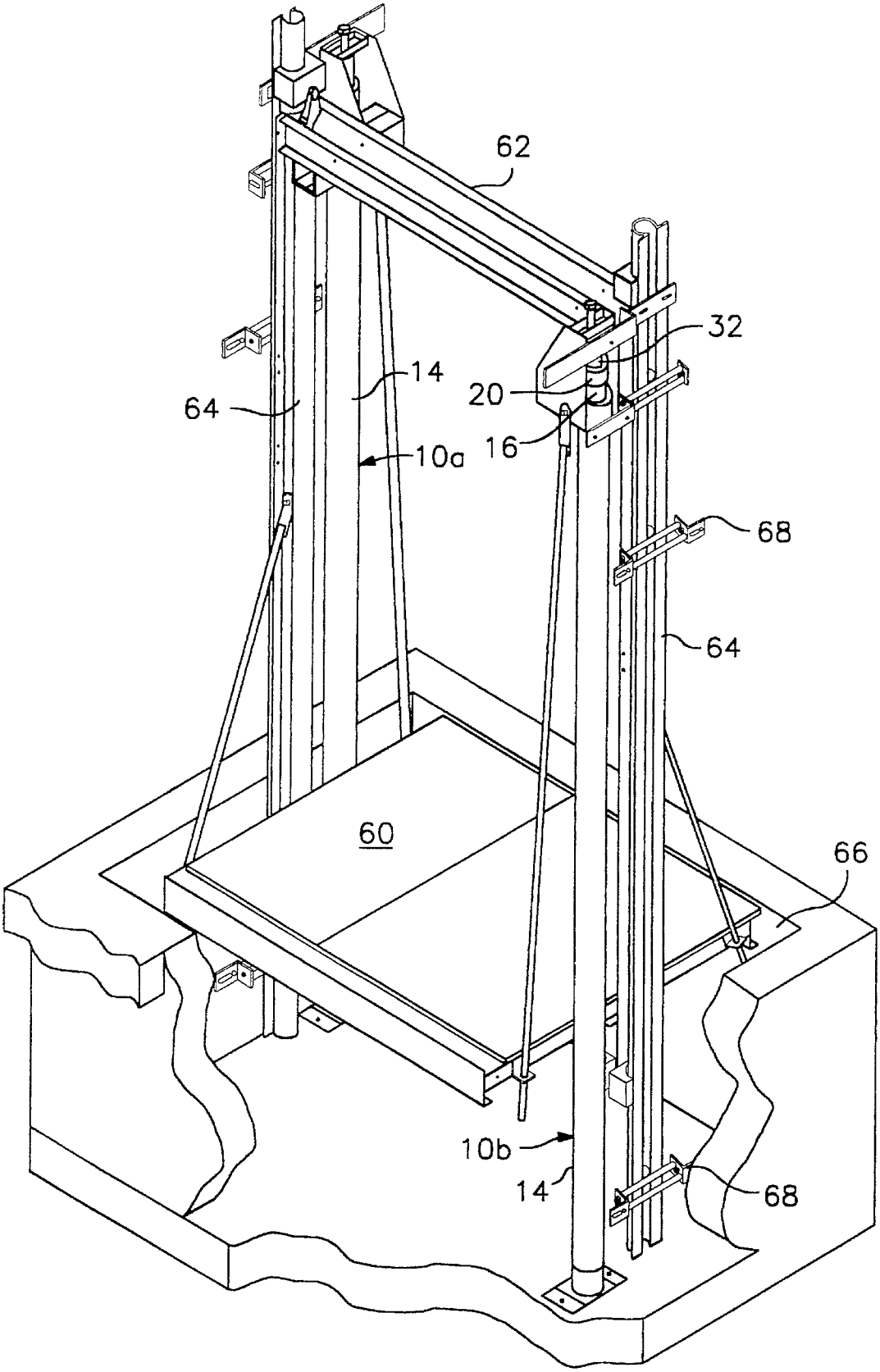
FIG. 2 is a perspective view of an elevator system according to the invention.

A preferred embodiment of an elevator system is shown generally in FIG. 2. The elevator has a pair of telescoping jacks **10*a*, 10*b*, each of which includes a first cylinder 14 mounted relative to the floor, an intermediate cylinder 16 including a seal housing 20 which extends radially outwardly relative to the cylinder 16, and an inner plunger 32. Jacks 10*a*, 10*b* may be similar to the jack 10 illustrated in FIG. 1 or any other telescoping jack which includes at least one intermediate cylinder which (in normal operation) moves in fixed relation to the inner plunger 32**.

The upper ends of the two inner plungers 32 are coupled to opposite ends of the upper cross member 62 of the car sling in a known manner, to support the car platform 60. A pair of vertically extending guide rails 64, which are mounted in the shaft 66 by brackets 68, are disposed on opposite sides of the car. The guide rails 64 utilized in the preferred embodiment are omega-shaped in cross-section, as described further in commonly owned Atkey U.S. Pat. No. 4,637,496.

Figure 3:
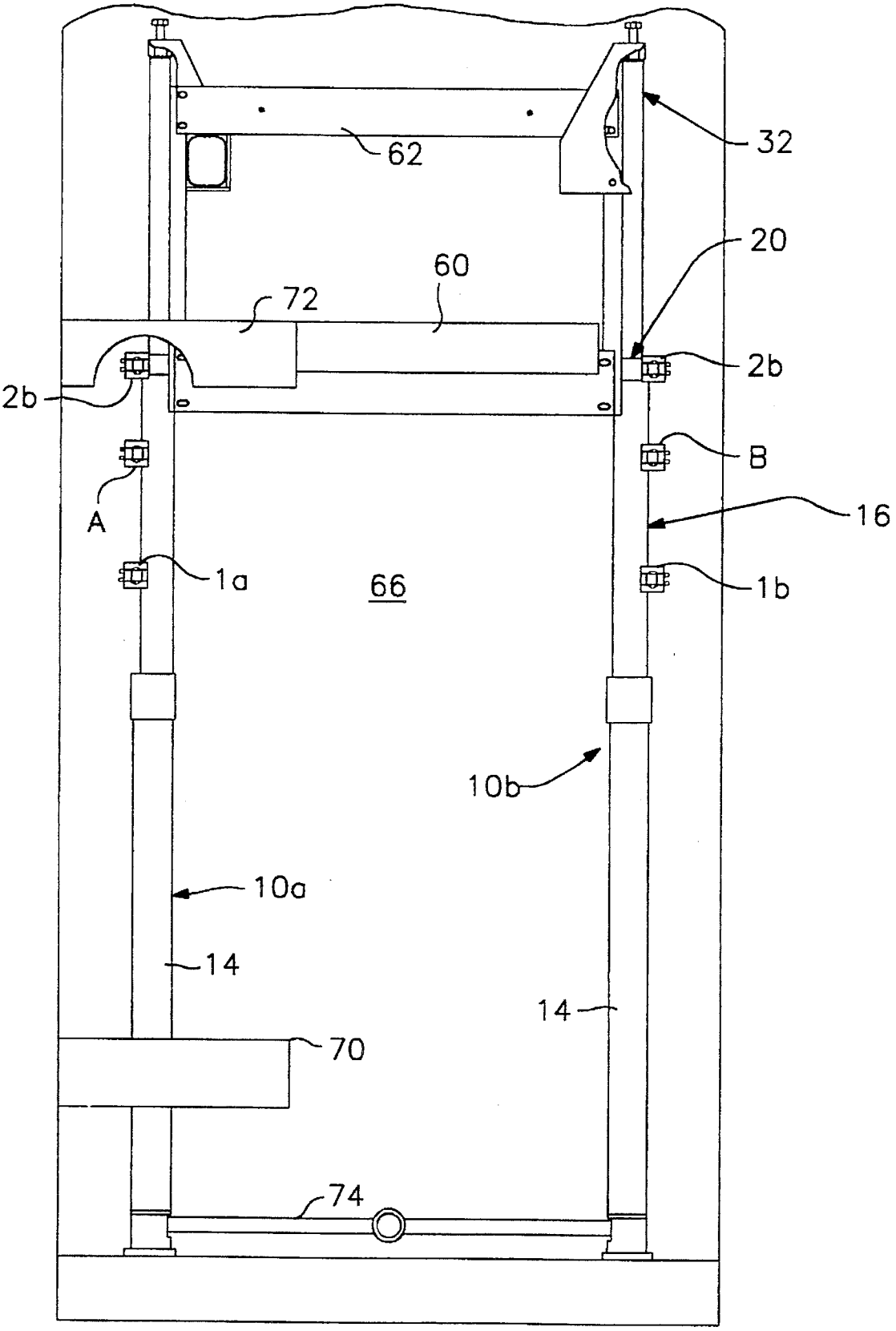
FIG. 3 is a front view of a two stop hydraulic elevator in accordance with the invention.

Referring to FIG. 3, in an exemplary embodiment the car platform 60 is moveable between a first floor landing 70 and a second floor landing 72. As shown, the fluid connection to the two jacks **10*a*, 10*b* from the pump (not shown) is by way of a common connecting pipe 74**, so that each jack is pressurized equally.

The elevator includes a first static sensor pair **1*a*, 1*b*, a second static sensor pair 2*a*, 2*b*, and a dynamic sensor pair labelled "A" and "B" in FIG. 3. The first static sensor pair 1*a*, 1*b* is positioned in the shaft 66 so as to be aligned with seal housing 20 when the car platform 60 is level with the first floor landing 70. The second static sensor pair 2*a*, 2*b* is positioned in the shaft so as to be aligned with the seal housing 20 when the car platform is level with the second floor landing 72. The dynamic sensor pair A and B are positioned below the static sensor pair for the top floor landing, which in the case of FIG. 3 is sensor pair 2*a*, 2*b*, so that the two seal housings 20** pass the dynamic sensors A and B as the car is approaching the top floor. This is desirable because an out-of-sync condition is most evident when the jack nears its full extension.

Figure 4:
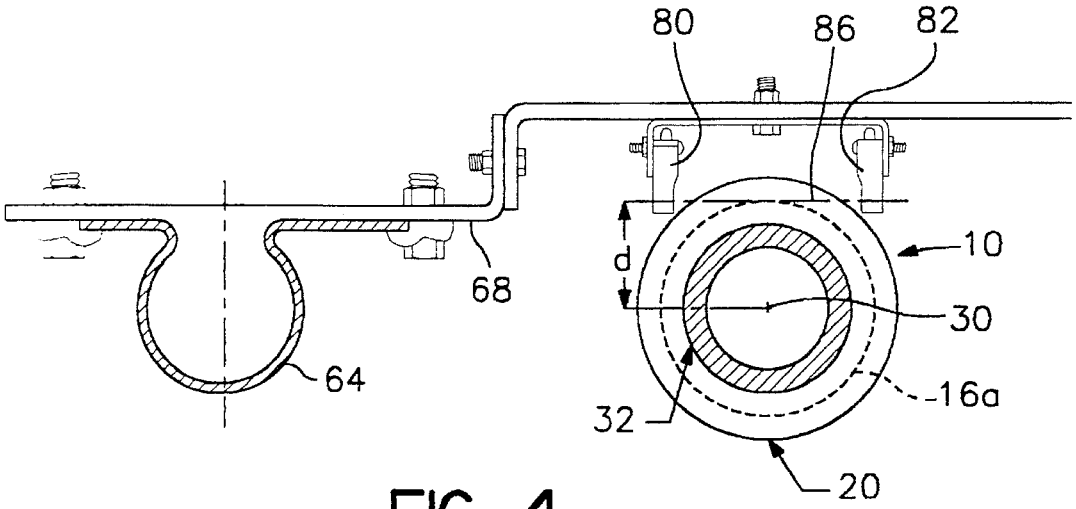
FIG. 4 is a top, sectional view of a portion of the elevator of FIG. 2, showing one of the jacks, a guide rail and a static sensor.

Referring to FIG. 4, in an exemplary embodiment each sensor includes a light emitter 80 and a detector 82, and is mounted on a rail bracket 68. As shown in FIG. 4, the emitter/detector pair 80, 82 is located a radial distance "d" from the center axis 30 of the jack 10.

In the case of the static sensors **1*a*, 1*b*, 2*a*, 2*b*, the distance "d" is such that the beam 86 emitted from the emitter 80 to the detector 82 is blocked by the seal housing 20, but would not be blocked by the outer wall 16***a* of the intermediate cylinder. In this manner, when the car is stopped on a floor, the detector 82 will be blocked by the seal housing 20 if the intermediate cylinder is at its predesigned extension, or at least within a predetermined range of normal. The tolerance range is determined by the vertical length of the seal housing 20. Preferably, the seal housing 20 is sized so that the detector 82 is blocked if the intermediate cylinder 16 is within four (4) inches of its normal extension. In this manner, if the cylinder is at its exact normal position, the beam 86 will be blocked by the seal housing 20. If the intermediate cylinder 16 is slightly below its normal position, but within 4 inches, the beam 86 will still be blocked by the seal housing 20. However, if the intermediate cylinder 16 is more than 4 inches below its normal position, the seal housing 20 will be completely below the beam 86, and the beam 86 will not be blocked.

The static sensors need to be positioned relatively precisely. If a static sensor is located too close to the axis 30, the detector will remain blocked, even when the seal housing 20 is above its normal position, by the cylinder wall 16*a*. If the seal housing is below the static sensor, i.e., so that the static sensor at the floor would not be blocked, the system may still not detect an out-of-sync condition, because static sensors on lower floors would be blocked by the wall 16*a*.

In contrast to the static sensors, the dynamic sensors A and B need only to sense when the beam is first blocked on an "up" run. Thus, it does not matter if the beam remains blocked by the outer wall 16*a* of the intermediate cylinder after the seal housing has passed and thus. It is desirable to locate the dynamic sensors A and B closer to the jack axis 30, and therefore the distance "d" is preferably less than the distance "d" for the static sensors, because the dynamic sensors are operational when the elevator is moving, and vibrations and movement of the jack laterally could cause sensing errors if the dynamic sensors are too far away from the jack.

Although the sensors are designated "static" and "dynamic", the same sensor device may be employed for both applications. In the exemplary embodiment, the sensors employed are a model SE61RNCMHS light detector, manufactured by Banner Engineering. However, other types of sensors, e.g., magnetic, may be employed. For example, hall effect sensors could be attached to the seal collar. Moreover, the vertical position of the intermediate cylinder 16 can be determined in ways other than by utilizing an outwardly projecting seal housing. For example, it would be possible to secure a vane or other device to the upper end of the intermediate cylinder 16 so as to detect its position.

Figure 5:
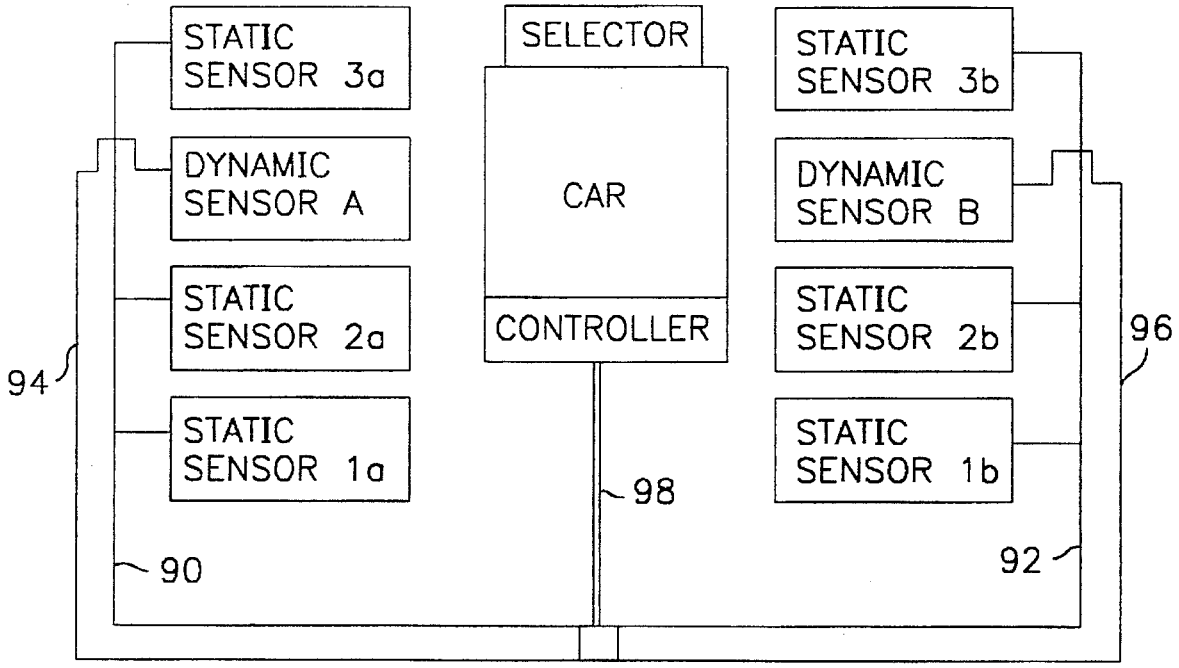
FIG. 5 is a block diagram of a three-stop elevator control system.

FIG. 5 illustrates the control system for a three stop elevator. The controller includes a processor for controlling car operations, including responding to hall and car calls, and a selector that provides information relating to the speed of the car and its location in the shaft. A static sensor pair 1*a*, 1*b*, 2*a*, 2*b*, and 3*a* and 3*b* are provided for the first, second and third floors, respectively.

The static sensor pairs 1*a*, 1*b*, 2*a*, 2*b*, and 3*a*, 3*b* are located physically far enough apart from one another that, when the car is at a given floor, the seal housing 20 can only actuate one sensor for each jack. Therefore, in the preferred embodiment, all the static sensor outputs for jack 10*a*, i.e., the outputs from sensors 1*a*, 2*a*, and 3*a*, are wired to a common output 90. Similarly, all the static sensor outputs for jack 10*b*, i.e., the outputs from sensors 1*b*, 2*b*, and 3*b*, are wired to a common output 92. These two outputs 90, 92, along with the two outputs 94, 96 from the two dynamic sensors A and B, are connected to the controller through the travelling cable 98. By wiring the static sensor outputs together, the number of cables to the controller are reduced, and the operational software is simplified.

The invention can readily be implemented with additional floors, merely by adding an additional static sensor pair for each floor, and relocating the dynamic sensors so as to be located below the static sensors for the top floor landing (i.e., so that they are actuated when the jacks are approaching the top floor and near full extension). Additional static sensors would be wired to the common wiring.

Figure 6A:
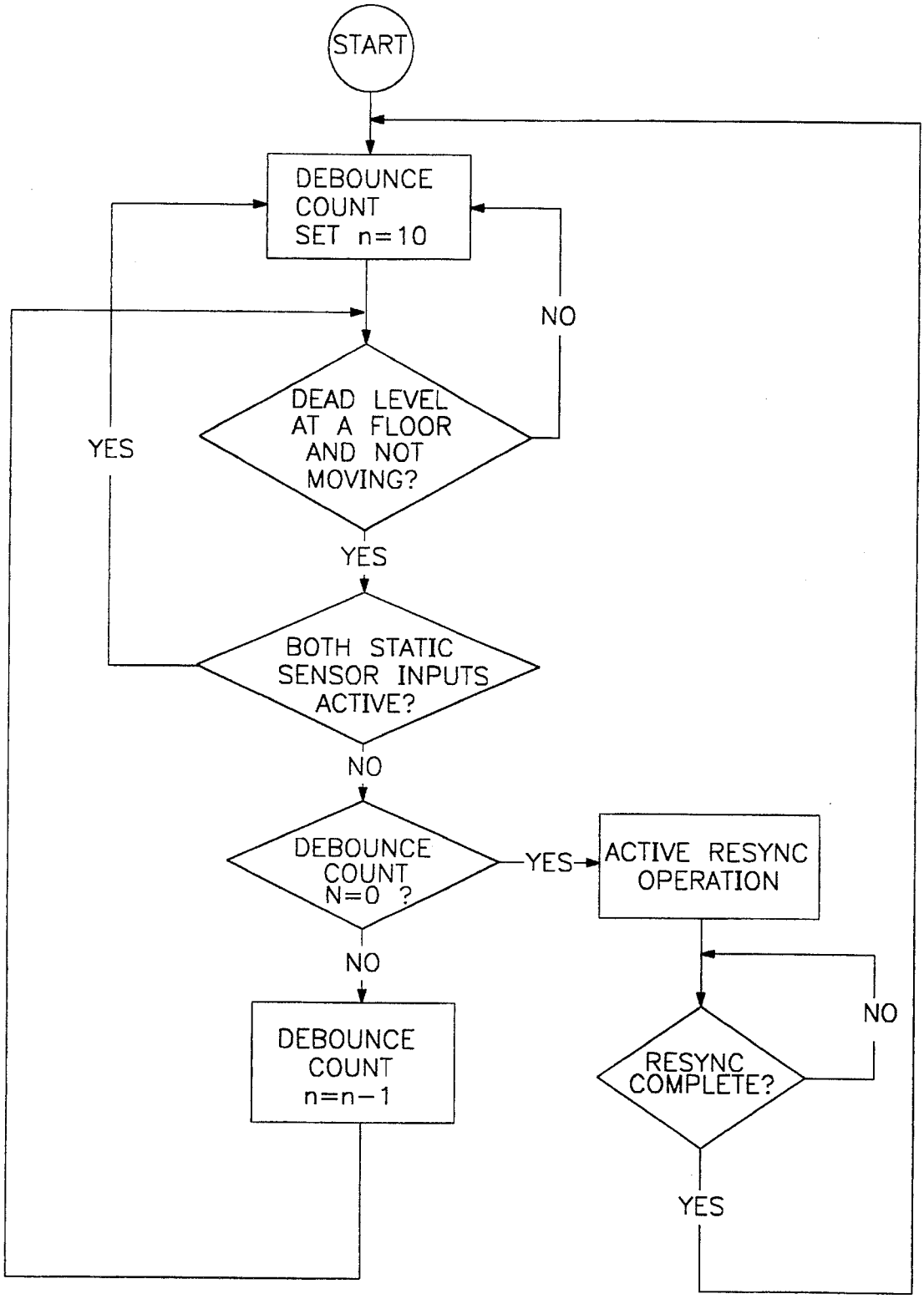

The operation of the elevator will be described in connection with FIGS. 6*a*–6*d*. Referring to FIG. 6*a*, the controller monitors input signals from the selector to determine when the elevator car is stopped at a floor. After determining that the car is level and not moving, the controller determines if both static sensor inputs are active. If either or both of the static sensors, e.g., 1*a* and 1*b*, are not blocked, indicating that the intermediate cylinder 16 is not within four (4) inches of its normal position, the controller decrements a debounce count and repeats the determination. If, after a predetermined number of debounce counts, one or both of the static sensors are still not blocked, the controller actuates an active resync subroutine, described below. Once the resync subroutine has been completed, the controller resumes the static sensor monitor. The purpose of the debounce delay is to allow the controller to ensure that, before making a determination that the jacks are out-of-sync, the elevator car has reached steady state.

Figure 6B:
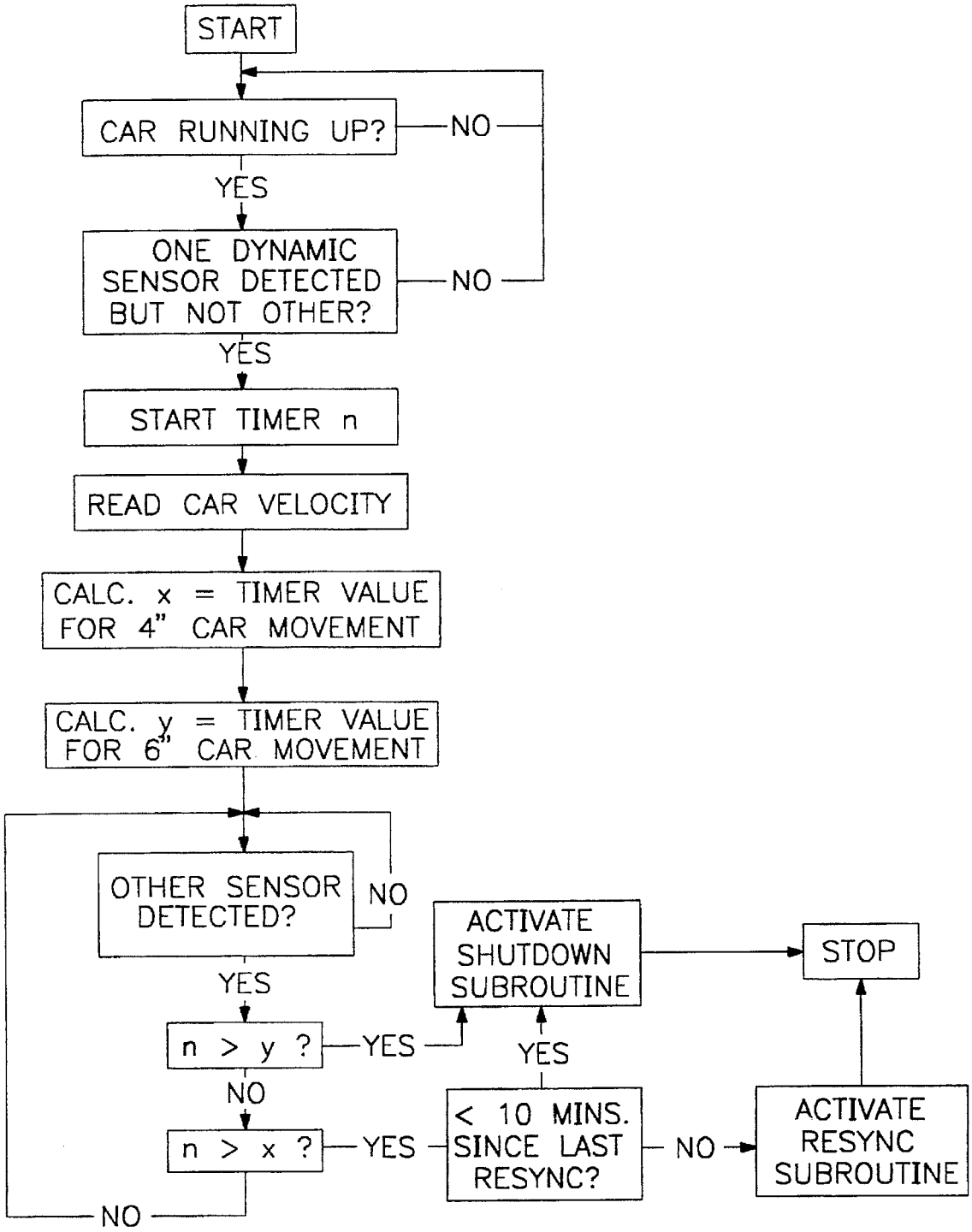

Referring to FIG. 6*b*, the controller also determines from selector signals when the car is in an up run. When the seal housing 20 passes one of the dynamic sensors, A or B, the controller determines if the other dynamic sensor has been detected. If it has not, the controller starts a timer, which determines elapsed time as a number "n" of elapsed, predetermined time intervals. The controller then reads the instantaneous car velocity from the selector, and calculates, as the value "x" of the number of time intervals "n" corresponding to 4 inches of car movement. It also determines, as the value "y", the number of time intervals corresponding to 6 inches of car movement.

The resolution needed on the timer can be determined based on the contract speed of the elevator, and the desired accuracy of measurement. For example, for a car velocity of 207 ft/min, or 24.2 msec/in (milliseconds per inch), a tick interval of 11.667 msec corresponds to 0.483 inches of travel, and therefore an accuracy reading of 0.966 inch. Thus, for a desired accuracy of 1 inch, the timer must have a resolution of approximately 11.667 msec or better.

In the preferred embodiment, a timer having an 8.750 msec resolution is employed. The controller determines the number of ticks "t" that correspond to the jacks being out of sync (values "x" and "y"), as follows:

$$D=V\times(t\times 8.750)$$

where D is the distance travelled, and "v" is the instantaneous velocity in units of in/msec. Thus, $$x=\frac{4\text{ inches}}{v\times 8.750}$$

$$y=\frac{6\text{ inches}}{v\times 8.750}$$

When the other dynamic sensor A or B is eventually sensed, the controller compares the elapsed time "n" first with the value "y". If "n" exceeds "y", it means that the first-detected seal housing A or B has travelled more than 6 inches before the other seal housing reached the same vertical position in the shaft. This means that the latter intermediate cylinder 16 is at least 6 inches out of synchronization, and the controller executes a shutdown subroutine, described below.

Assuming that "n" does not exceed "y", the controller determines if "n" exceeds "x", which would indicate that the trailing intermediate cylinder is more than 4 inches out of sync If "n" exceeds "x", indicating a need for resynchronization, the controller first determines the time elapsed since the last resynchronization. If such time is less than a predetermined interval, indicating that the last resynchronization was probably not effective, or that some further problem exists, the controller initiates the shutdown subroutine. If the time since the last resynchronization exceeds the threshold, the controller activates the resync subroutine.

Figure 6C:
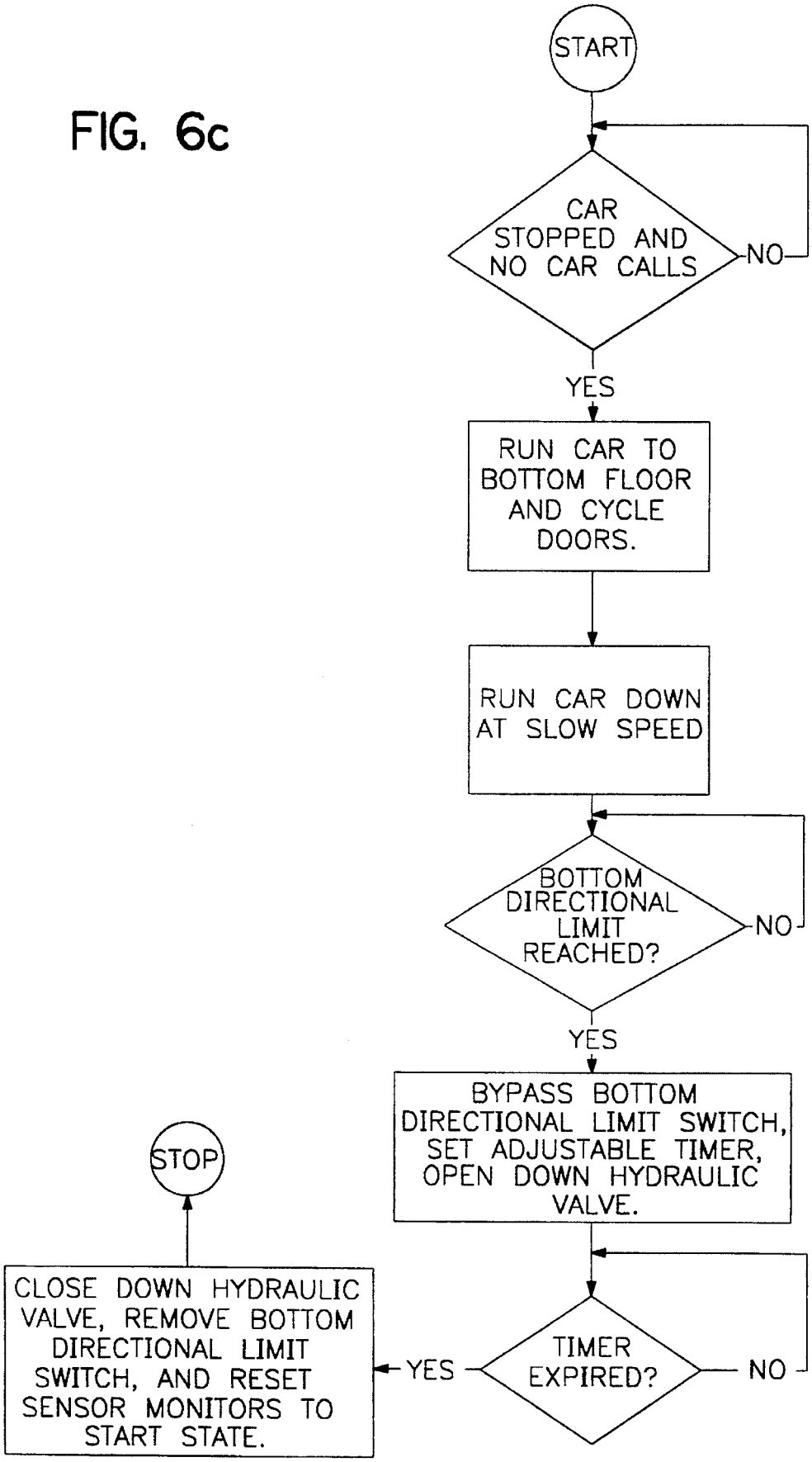
Figure 6D:
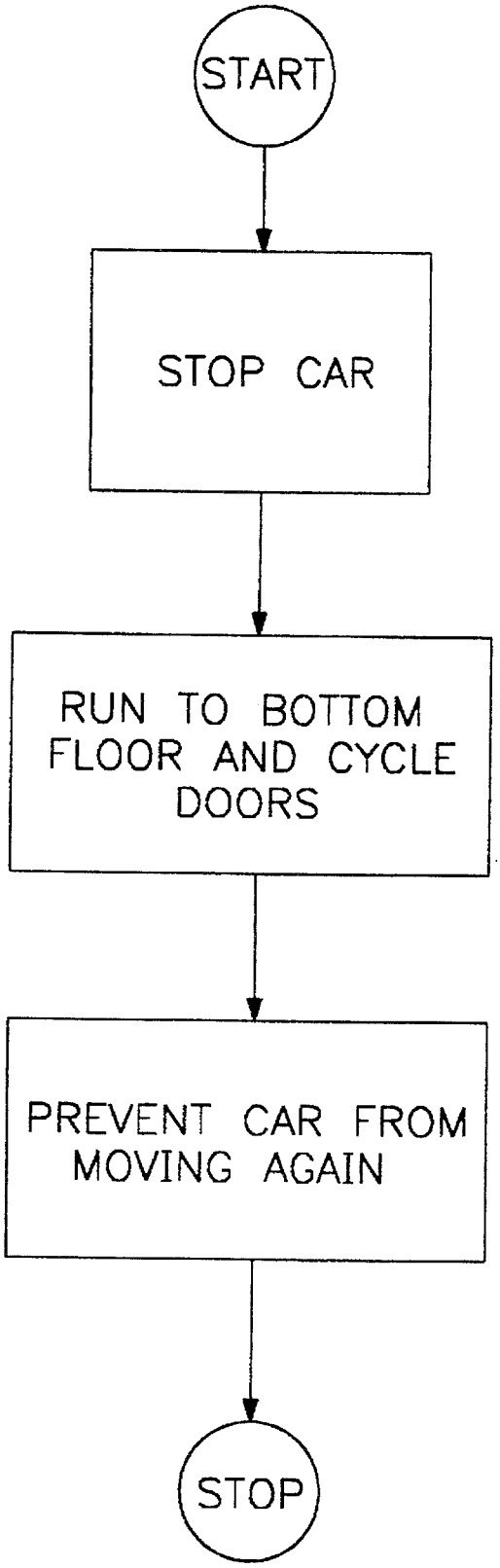

The resync subroutine is illustrated in FIG. 6*c*. When the car has discharged any car or hall calls, and is stopped, the controller lowers the car to the bottom floor, and opens and closes the doors. The controller then lowers the car slowly to the bottom directional limit. When the limit is encountered, the controller by-passes the limit, starts a timer, and opens the down hydraulic valve. When further downward movement of the car causes the valve connecting the lower and upper chambers to open, fluid is transferred to refill the upper chamber. Once the timer expires, the down hydraulic valve is closed, and the pump is started, which will cause the jacks to move upwardly, closing the valve to the upper fluid chamber. The bottom directional limit switches are reactivated, and the sensor monitoring routine is reset to its start state.

Referring to FIG. 6, when the controller activates the shutdown subroutine, it immediately interrupts any upward run, lowers the car to the bottom floor, opens and closes the doors, and shuts the car down.

The foregoing represents a description of preferred embodiments of the invention. Variations and modifications will be evident to persons skilled in the art, without departing from the inventive principles disclosed herein. For example, while the invention has been described relative to a telescoping jack having a single intermediate cylinder, telescoping jacks are known having more than one intermediate cylinder, and may be employed with the present invention. In such a case, it is desirable to employ a system of static sensor and dynamic sensor pairs as described above for each of the two intermediate cylinders. Such system would otherwise be the same as the embodiments described above, except that some of the static sensors would need to be wired individually to the controller, so that the controller could determine which sensor is blocked (i.e., because the larger intermediate cylinder may block, at certain times, certain of the sensors for the smaller intermediate tube). All such modifications and variations are intended to be within the scope of the invention, as defined in the following claims.

We claim:

1. In a hydraulic elevator system having a car moveable in a shaft between at least two floors, a pair of telescoping jacks for supporting said car at spaced locations and for raising and lowering said car between floors, wherein each telescoping jack has a first cylinder coupled to the car, a second cylinder fixed relative to the ground, and at least one intermediate cylinder, the improvement comprising sensing means located at least one predetermined vertical position in said shaft for detecting each said intermediate cylinder, and processor means connected to each sensing means for determining relative differences in height between the intermediate cylinders for determining when the two jacks are out of synchronization.

2. A hydraulic elevator system according to claim 1, wherein said sensing means comprises a pair of static sensors, one associated with each jack, and which are located in said shaft so as to be actuated by a respective intermediate cylinder when the jack is in synchronization and the car is stopped at a predetermined floor.

3. A hydraulic elevator system according to claim 1, wherein said sensing means comprises a pair of dynamic sensors, one associated with each jack, and which are located in said shaft at a predetermined vertical position and so as to be actuated by a respective intermediate cylinder during an up run, and wherein said processor means includes means for determining relative differences in height between the two intermediate cylinders at the time said intermediate cylinders pass said dynamic sensors.

4. A hydraulic elevator system according to claim 3, wherein said sensing means further comprises a pair of static sensors, one associated with each jack, and which are located in said shaft so as to be actuated by a respective intermediate cylinder when the jack is in synchronization and the car is stopped at a predetermined floor.

5. A hydraulic elevator system according to claim 4, wherein said sensing means includes a static sensor pair associated with each floor, wherein each pair is located in said shaft so as to be actuated when the jack is in synchronization and the car is stopped at a respective floor.

6. A hydraulic elevator according to claim 5, wherein said car is moveable between at least three floors, including a top floor, and wherein said dynamic sensors are located to be actuated when said car is approaching the top floor.

7. A hydraulic elevator system according to claim 5, where each static sensor has means for producing an output signal, and wherein the output signals of the static sensors associated with one intermediate cylinder are connected to common wiring to provide a first input to said processor, and wherein the output signals of the static sensors associated with the other intermediate cylinder are connected to common wiring to provide a second input to said processor.

8. A hydraulic elevator according to claim 2, wherein each intermediate cylinder has a center axis and a seal housing at its upper end that projects outwardly from said axis a distance greater than said intermediate cylinder, and wherein said static sensors are located at a distance from said center axis so as to detect said seal housing but not said intermediate cylinder.

9. A hydraulic elevator according to claim 4, wherein each intermediate cylinder has a center axis and includes a seal housing at its upper end that projects outwardly from said axis a distance greater than said intermediate cylinder, wherein said static sensors are located at a distance from said center axis so as to detect said seal housing but not said intermediate cylinder; and wherein said dynamic sensors are located closer to said axis than said static sensors.

10. A hydraulic elevator according to claim 1, wherein said processor means includes means for initiating resynchronization of said jacks automatically in response to detecting more than a first predetermined difference in height between said intermediate cylinders.

11. A hydraulic elevator according to claim 10, wherein said processor includes means for shutting down said elevator in response to performing greater than a preset number of resynchronizations over a given time period.

12. A hydraulic elevator according to claim 10, wherein said processor comprises means for shutting down said elevator in response to detecting a second predetermined difference in height between said intermediate cylinders, said second predetermined difference being greater than said first predetermined distance.

13. A hydraulic elevator according to claim 12, wherein said processor includes means for shutting down said elevator in response to performing greater than a preset number of resynchronizations over a given time period.

14. A hydraulic elevator according to claim 3, comprising means for determining instant elevator speed, wherein said processor includes means for determining the time interval between actuation of the respective dynamic sensors, and means for determining relative differences in height between the two intermediate cylinders as the product of the time interval and instant elevator speed.

* * * * *